US009618176B2

(12) United States Patent
Hansmann et al.

(10) Patent No.: US 9,618,176 B2
(45) Date of Patent: Apr. 11, 2017

(54) VENTILATION SYSTEM FOR VEHICLE LIGHTING

(71) Applicants: Hella KGaA Hueck & Co., Lippstadt (DE); AZ Ausruestung und Zubehoer GmbH & Co. KG, Hattingen (DE)

(72) Inventors: Frank Hansmann, Lippstadt (DE); Jens Oliver Meyer, Wuelfrath (DE); Michael Wysok, Hattingen (DE)

(73) Assignees: Hella KGaA Hueck & Co., Lippstadt (DE); AZ Ausruestung & Zubehoer GmbH & Co. KG, Hattingen (DE)

( * ) Notice: Subject to any disclaimer, the term of this patent is extended or adjusted under 35 U.S.C. 154(b) by 87 days.

(21) Appl. No.: 14/707,633

(22) Filed: May 8, 2015

(65) Prior Publication Data

US 2015/0323150 A1 Nov. 12, 2015

(30) Foreign Application Priority Data

May 8, 2014 (DE) ..... 10 2014 106 502

(51) Int. Cl.
*F21S 8/10* (2006.01)
*F21V 29/83* (2015.01)

(52) U.S. Cl.
CPC ..... *F21S 48/328* (2013.01); *F21S 48/321* (2013.01); *F21S 48/335* (2013.01); *F21V 29/83* (2015.01); *F21S 48/337* (2013.01)

(58) Field of Classification Search
CPC ..... F21S 48/328; F21S 48/335; F21S 48/321; F21S 48/337; F21V 29/83
See application file for complete search history.

(56) References Cited

U.S. PATENT DOCUMENTS 5,758,957 A 6/1998 Perrotin
6,042,255 A 3/2000 Kibayashi
(Continued)

FOREIGN PATENT DOCUMENTS

EP 1205706 A2 5/2002
EP 0764811 B1 11/2002
(Continued)

OTHER PUBLICATIONS

European Search Report in European Application No. EP15165852, dated Aug. 31, 2015.

*Primary Examiner* — David V Bruce
(74) *Attorney, Agent, or Firm* — Patent Central LLC; Stephan A. Pendorf

(57) ABSTRACT

The invention relates to a ventilation system for vehicle lighting systems having a housing opening with a protruding opening wall and a ventilation body, which is fixed to the housing opening by engagement with an inner part. The ventilation body and the housing opening have walls for forming a ventilation duct with a plurality of direction changes between an edge of the ventilation body and an aperture of the housing opening, wherein an inner part and an outer part which surround the opening wall of the housing opening have walls, which respectively sectionally lie circumferentially sealingly against the opening wall of the housing opening, and wherein the ventilation body and the housing opening are formed such that the ventilation body can be brought from an unlocked position into a locked position or vice versa by rotation according to a predetermined angle of rotation relative to the housing opening.

10 Claims, 4 Drawing Sheets

(56) References Cited

U.S. PATENT DOCUMENTS

Figure 1:
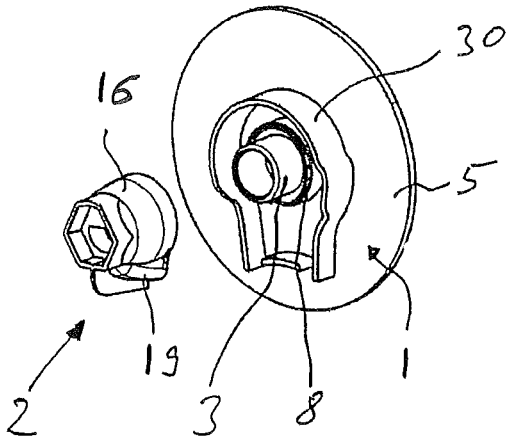

| | | | | |
|---|---|---|---|---|
| 2011/0267829 | A1* | 11/2011 | Horng | F21S 8/026<br>362/373 |
| 2013/0194818 | A1 | 8/2013 | Gomez et al. | |

FOREIGN PATENT DOCUMENTS

| | | | |
|---|---|---|---|
| EP | 2620702 | A1 | 7/2013 |
| GB | 1472189 | A | 5/1977 |
| GB | 2237626 | A | 5/1991 |
| JP | 2005349362 | A | 12/2005 |
| JP | 2007059200 | A | 3/2007 |

* cited by examiner

VENTILATION SYSTEM FOR VEHICLE LIGHTING

The invention relates to a ventilation system for vehicle lighting including a housing opening with a projecting opening wall, a ventilation body which is fixed to the housing opening by engagement of an inner part thereof, wherein the ventilation body and the housing opening have walls for forming a ventilation duct with a plurality of direction changes between an edge of the ventilation body and an opening of the housing opening.

From EP 1205706 A2 a ventilation system for a vehicle lamp is known in which the ventilation system is provided on a rear side of a housing. At the housing opening of the housing a plurality of outwardly projecting walls of different height are provided onto which a cap-shaped ventilation body can be seated. A labyrinthine ventilation duct is formed. The cap-shaped ventilation body is lockingly connected to walls of the housing opening, wherein the cap-shaped ventilation body, for accessing the fixing position, is inserted in the axial direction on the walls of the housing opening.

EP 0764811 B1 discloses a ventilation system for vehicle lighting comprising a housing, in which a cap-shaped ventilation body is mounted axially on a housing opening and is fixed in a latching manner with the latter. The ventilation body and the housing opening have walls so that a ventilation duct is formed with a plurality of baffles or direction changes between an edge of the ventilation body and an opening of the housing opening. The fixing of the ventilation body is by means of a latching element which engages into the opening of the housing opening. Fixing is by axial snapping of the locking element into the opening of the housing opening, with barbed ends of the locking element engaging behind a wall of the housing.

The object of the present invention is to develop a ventilation system such that a simple assembly and secure fixation is possible, which ensures a high degree of sealing and a variable employment.

To achieve the object, the invention, in connection with the preamble of claim 1, is characterized in that the inner part and the opening wall of the housing opening surrounding outer part have walls, which respectively in some sections lie sealingly against the opening wall of the housing opening in the circumferential direction, the ventilation body and the housing opening are formed such that the ventilation body, by rotation relative to the housing opening by a predetermined angle of rotation, can be moved from an unlocked position into a locked position or vice versa.

According to the invention, a ventilation body exhibits on the one hand an inner part projecting into the housing opening and on the other hand an outer part surrounding the opening wall of the housing opening, of which the walls assume a housing opening sealing function. The ventilation body is formed as a rotation cap, so that the fixing occurs by rotation of the ventilation body relative to the housing opening about an axis thereof. This results in a long-term stable fixation and an encoding of the ventilation system, which ensures a secure fixing assembly of different ventilation bodies in the same housing opening.

According to a preferred embodiment of the invention, the opening wall of the housing opening is formed in two stages. On the one hand, an opening of the housing opening is bounded by a high opening wall, whose free edge is at a relatively large distance from a housing wall which is at a plane perpendicular to the axis of the housing opening. On the other hand, at a radial distance to the high opening wall a low opening wall is provided, the free edge of which having relatively small distance from the housing wall. The high opening wall is mainly used for contact supporting at an inner side of an inner part. On a rear side, the high opening wall has locking elements to establishing the internal part in the locking position on the housing opening. The low opening wall serves to seal the contact with the outer part. Because the low opening wall has a region with a recess, a passage for an end of the ventilation channel can be formed there, with a first direction change of the ventilation duct. The low opening wall as well as the outer part enable a curved flow of the ventilation channel, whereby the ventilation duct is divided at the recess of the opening wall into two arc-shaped ventilation duct sections. The inner part and the high opening wall are in this case flowed about in the circumferential direction, until an axial ventilation channel section is arrived at on the side opposite to the recess of the inner part, which extends between the high opening wall and the inner part. There, a second direction change of the ventilation channel is provided. Thereby, a labyrinth-like ventilation duct is advantageously formed and at the same time the ventilation body is sealingly fixed to the housing opening.

According to a further development of the invention, the inner part of the ventilation body, and the high opening wall at a rear side, have locking elements, which enables a form-fitting and/or frictional locking of the ventilation body on the housing wall by rotation of the ventilation body about an axis of the housing opening. Advantageously a secure bayonet fixing is thereby ensured, wherein the ventilation body in the locking position assumes a defined mounting position relative to the housing opening.

According to a further development of the invention, the locking elements of the inner part of the ventilation body are formed to protrude radially, so that in the locking position they engage in a latching manner in an arcuate portion of the locking element disposed on the back side of the high opening wall. In this way, an axial retention force can be exerted which holds the ventilation body sealingly and securely in position in the locked position.

According to another embodiment, a bottom-side edge of the high opening wall is contour designed such that only one type of ventilation bodies, from a plurality of different types of ventilation bodies, can be brought into the locking position. As a result, there is provided a "hard coding", which determines the compatibility of the housing opening to vent bodies, including also, for example, those provided with a membrane.

According to a further development of the invention the ventilation body has, on the outer part of the ventilation body, a radial projection or bulge corresponding to the recess of the lower opening wall. As a result, an end of the ventilation channel is defined on one side of the ventilation body, wherein this end is preferably arranged in a vertically lower region of the ventilation system. Advantageously in this way the ingress of unwanted fluid into the housing can be avoided.

In a further development of the invention, the inner part has a foot, which is basically located on one of the half sections facing the radial projection or bulge. A radial surface of the foot section serves as a bearing surface at an inner side of the high opening wall. The inner part has, on a side facing away from the radial projection or bulge, a recess or, as the case may be, a direction change base or land, so that an axial section of the ventilation channel is formed which extends from the free edge of the opening wall to a bottom plane of the opening wall. Due to the fact that the inner part is formed in a flattened extending portion adjoining the foot section, the axial portion of the ventilation channel can be formed in the locking position of the ventilation body.

According to a development of the invention, the housing opening has a mounting frame arranged a radial distance from the high opening wall and the lower opening wall, whose radius is larger only in a particular rotational angle range of the ventilation body than a radius of the radial projection of the ventilation body. In this way, a defined position for insertion of the ventilation body in the unlocked position is defined, or a predetermined rotation of the ventilation body from the unlocked position into the locking position and vice versa. Advantageously, assembly is thereby facilitated. In addition, the mounting frame provides a splash guard of the ventilation system.

Other advantages of the invention will become apparent from the other dependent claims.

An embodiment of the invention is explained in more detail with reference to the drawings.

Figure 2:
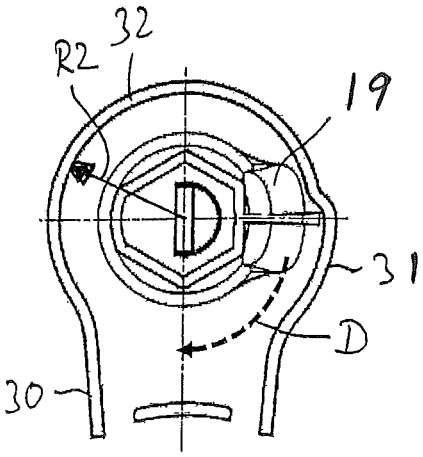
Figure 3:
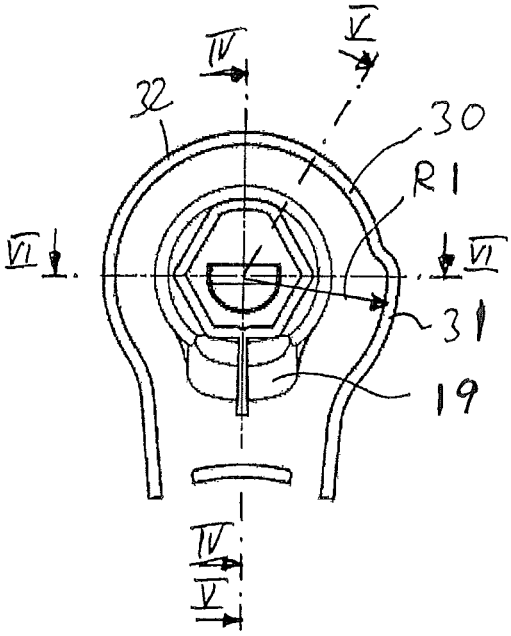
Figure 4:
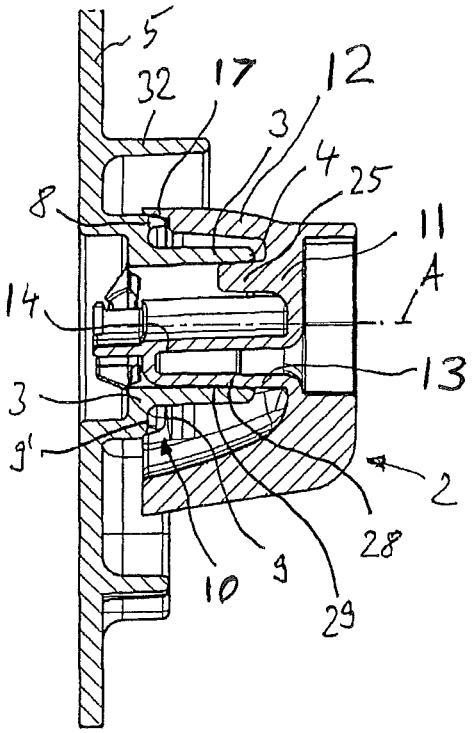
Figure 5:
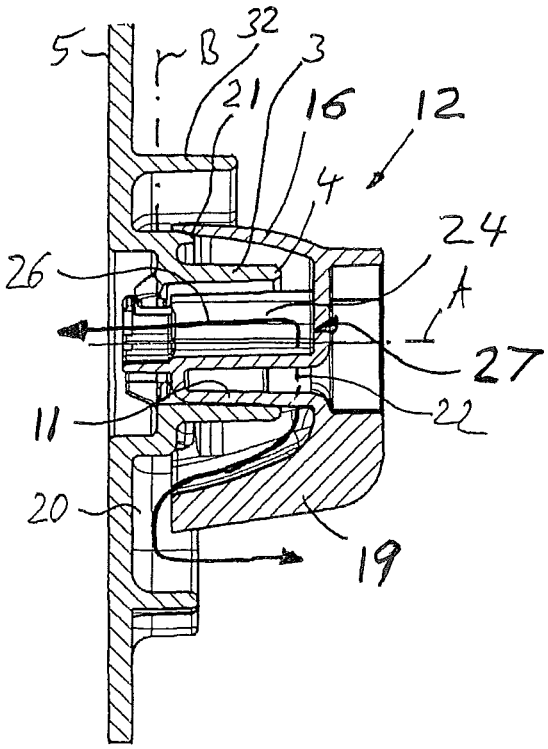
Figure 6:
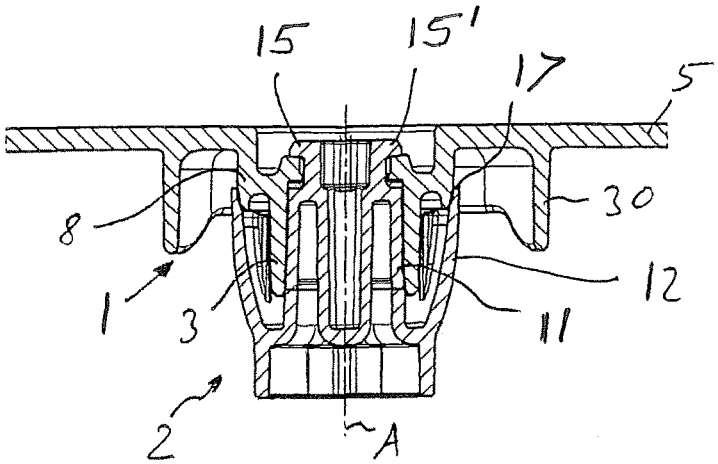
Figure 7:
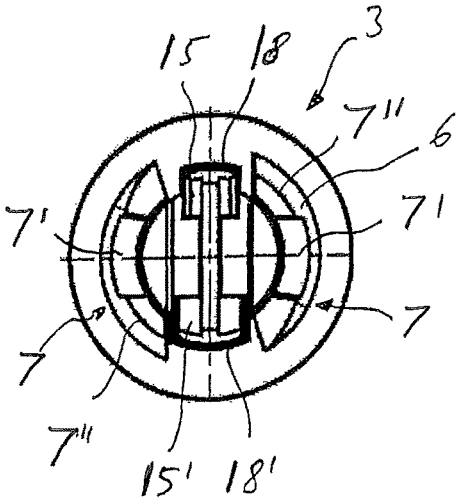
Figure 8:
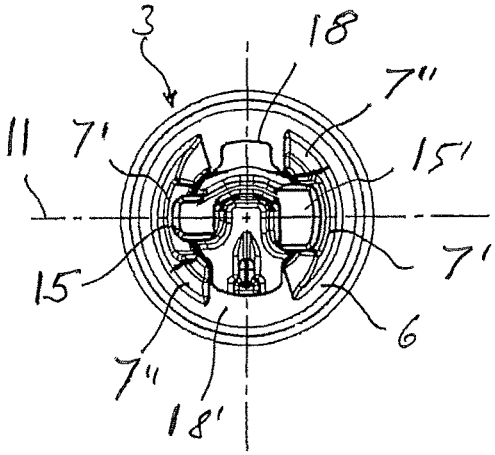
Figure 9:
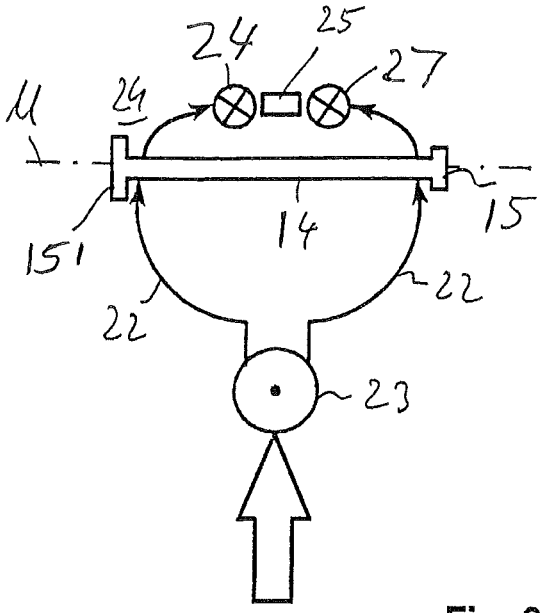

It shows:

FIG. 1 is an exploded view of a ventilation system with a housing opening and a ventilation body, FIG. 2 is a front view of the ventilation system in an unlocked position of the ventilation body, FIG. 3 is a front view of the ventilation system in a locking position of the ventilation body, FIG. 4 shows a vertical section through the ventilation system along the section line IV-IV in FIG. 3, FIG. 5 shows a section through the ventilation system taken along section line VV in FIG. 3, FIG. 6 shows a horizontal section through the ventilation system along the section line VI-VI in FIG. 3, FIG. 7 is a rear view of the ventilation system in an unlocked position of the ventilation body, FIG. 8 is a rear view of the ventilation system in a locked position of the ventilation body, and FIG. 9 is a schematic representation of the flow of a ventilation system formed by the ventilation channel.

An inventive ventilation system can be used for vehicle lighting, especially headlights. Alternatively, the ventilation system can be used for the ventilation and/or pressure equalization of other enclosures, for example, control modules, batteries.

A lighting device for a vehicle can be arranged in the forward or rear region of the vehicle. The lighting device comprises a housing in which at least one light source and a therewith associated optics unit are arranged for generating a light beam. By means of the light beam, a predetermined light distribution, such as a low beam or high beam distribution, can be generated. The housing, comprised of a rigid material, has an opening on the front in the main direction of illumination, which is covered by a translucent lens. At a rear side of the housing, preferably on a vertical housing wall 5 of the housing, a ventilation system is provided for mutual exchange of air between an interior of the housing and the environment. The ventilation system is formed on the one hand by a housing opening 1 of the housing wall 5 and on the other hand by forming a ventilation body 2 lockable to the housing opening 1. The term housing opening 1 refers to the area of the housing wall 5, in which an opening is provided.

The ventilation body 2 is integrally formed as an injection-molded part, which is preferably made of the same rigid material as the housing or the opening integrally formed on the housing.

The housing opening 1 has a high opening wall 3, which is cylindrical and has a circular free edge 4 which is arranged at a relatively large distance from the housing wall 5. The high opening wall 3 has at a bottom edge 6, which is arranged offset in the housing wall 5, by means of which annular locking members 7 of the ventilation body 2 may be fixed to the housing opening 1 form fitting and/or friction fitting. The locking elements 7 extend coaxially to an axis A of the high opening wall 3 and the housing 1. The opening locking members 7 extend in a bottom plane B of the housing opening 1, which is perpendicular to the axis A of the housing opening 1.

At a radial distance from the high opening wall 3 this is surrounded by a low opening wall 8, which has a free edge 9 which in comparison to the edge 4 of the high opening wall 3 has a smaller distance to housing wall 5 extending substantially perpendicular to the axis A. The low opening wall 8 preferably has a recess 10 in a vertically lower portion, whose edge 9' is a smaller axial distance from the housing wall 5 than the remainder of the edge 9 of the lower opening wall 8. The lower opening wall 8 is arranged coaxial with the high opening wall 3. The recess 10 extends at an acute angle range around the axis A, preferably at an angle ranging from 20° to 30°.

The ventilation body 2 comprises an inner part 11 engaging in the high wall 3 and an outer part 12 extending outside of the high opening wall 3. The outer part 12 surrounds the high opening wall 3 or, as the case may be, the low opening wall 8.

The ventilation body 2 forms a twist lock with the housing opening 1, wherein the ventilation body 2 by axial attachment to the housing opening 1 according to FIG. 2 can be brought from an unlocked position into a locked position by rotation in the direction of rotation D (clockwise) about the axis A shown in FIG. 3, in which the ventilation body 2 is fixed to the housing opening 1. The rotation angle by which the ventilation body 2 is rotated relative to the housing opening 1 from the unlocked position into the locked position and vice versa in the present embodiment is 90°. Alternatively, the rotation angle can also be made smaller or greater when the inner part 11 of the ventilation body 2 and the housing opening 1 are correspondingly contoured.

The inner part 11 has a foot portion 13 which is integrally connected to the outer part 12. A flattened extension section 14 extends from the foot portion 13, which is provided at a free end with locking elements 15, 15' for releasably securing the ventilation body 2 to the housing opening 1.

The outer part 12 has a circumferentially closed wall 16, which extends at a radial distance from the foot section 13 or as the case may be the extension section 14 of the inner part 11. The outer part 12 is cup-shaped, at the inner bottom of which the base-like inner part 11 protrudes, of which the free end with the locking elements 15, 15' extends out beyond an extension plane formed by a free edge 17 of the outer part 12.

The locking elements 15, 15' of the inner part 11 are disposed on opposite sides of the extension section 14 and have, for the coding of the ventilation body 2, different widths, so that the ventilation body 2 with the locking elements 15, 15' can reach through the base plane B of the high opening wall 3 only in a single rotational position, see FIG. 7. The high opening wall 3 has at the bottom edge 6 notches 18, 18' of different widths corresponding to the widths of the locking members 15 and 15', so that in the unlocked position only this type of ventilation body can be introduced or pass through. The contouring of the notches 18, 18' and of the locking members 15, 15' thus enable coding of the ventilation system, which ensures that only the predetermined ventilation body 2 can be locked with an open ventilation channel. A ventilation body of a different type, e.g., with an integral membrane, would have, for example, complementarily formed locking elements, which prevent, due to other measures, namely, by defining the insertion position of the unlocked condition by providing a predetermined mounting frame 30.

The locking elements 7 of the high opening wall 3 are formed by a bottom arcuate section 7', extending along an acute angle about the axis A, and by a detent portion 7", which is located at one end of the arcuate section 7'. The arcuate section 7' has the same radius as the locking members 15, 15', so that upon rotation of the ventilation body 2 relative to the housing opening 1, the locking members 15, 15' engage behind the respective arcuate portions 7' and thus generate an axial holding force between the housing opening 1 and the ventilation body 2. Further rotation of the ventilation body 2' is prevented by the striking of the locking members 15 against the blocking portion 7". The blocking portion 7" has, with respect to the base plane B, greater height or axial distance than the arcuate portions 7', so that the axial surface of the blocking portion 7" is used as a stop for the locking elements 15, 15' at the opposite sides.

The outer part 12 of the ventilation body 2 has a radial bulge 19, whose wall has, in the assembled position of the ventilation body 2, such a large radial distance from the lower opening wall 8, that an opening 20 is formed for forming an end of the ventilation channel. The other regions of the wall 16 of the outer part 12 lie on the outside of the lower opening wall 8, thus establishing a seal between the ventilation body 2 and the housing opening 1. As can be seen in FIGS. 4 and 5, due to the radial distance between an edge of the bulge 19 and the low opening wall 8, the opening 20 is formed.

So that the ventilation body 2 assumes a defined axial position, the outer part 12 has circumferentially arranged distributed stop members 21 which come to rest on a free edge of the lower opening wall 8.

Since the foot portion 13 of the inner part 11 is arranged on half side facing the bulge 19, two arc-shaped ventilation duct sections 22 are formed, extending between a first direction change 23 in the region of the opening 20 and a median plane M of the extension section 14. On a sides opposite the bulge 19, the inner part 11 has a release 24 or direction change base or projection 25, so that an axial ventilation channel portion 26 may connect to the two arc-shaped ventilation duct sections 22, see arrow in FIG. 5, which represents the flow of the ventilation duct. In the region of the transition between the release 24 and the root portion 13 a second direction change 27 of the ventilation duct occurs. The axial ventilation duct section 26 extends between the second direction change 27 and the base plane B of the high opening wall 3, wherein the extension section 14 and a section of the high opening wall 3 arranged on a side opposite the bulge 19 bound this axial ventilation duct section 26. In the locked position, a continuous ventilation channel is thus formed between a, in the vertical direction, lower edge of the outer portion 12 of the ventilation body 2 and a, in the vertical direction, upper opening half of the high opening wall 3.

In the locked position, the foot portion is 13 lies with a semicircular radial surface 28 sealingly against an inner side 29 of the high opening wall 3.

A sealing of the ventilation body 2 against the housing opening 1 in the locked position is thus effected on the one hand in a vertically lower region by sealing engagement of the inner part 11 against the high opening wall 3 and on the other hand in a vertically upper region by abutment of the edge 17 of the outer part 12 against the lower opening wall 8. The sealing contact of the edge 17 of the outer member 12 preferably encloses an obtuse angle, in particular an angle between 270° and 330° about the axis A. The sealing engagement of the foot portion 13 of the inner part 11 against the opening wall 3 preferably encloses an obtuse or reflex angle or 180° about the axis A. In this way, a separate seal can be dispensed with. The wall 16 of the outer part 12 forms a flexible sealing face, which rests sealingly on an outer side of the lower opening wall 8, so that the wall 16 is friction fittingly connected in the radial direction with the lower opening wall 8. In this way on the one hand a sealing function and on the other hand a fastening function is achieved, wherein via the fastening function it is prevented that the ventilation body 2 can be detached from the housing due to vibration during operation of the ventilation system.

For coded attaching of the ventilation body 2 onto the housing opening 1, the mounting frame 30 is provided with a bulge 31. The bulge 31 has a radius R1 that is larger than a radius of the radial bulge 19. An arcuate portion 32 of the mounting frame 30 adjacent recess 31 has a radius R2 which is smaller than the radius of the bulge 19. Since the mounting frame 30 extends essentially in a reflex angle and is designed to be open in the vertical downward direction, the ventilation body 2 can be mounted axially in the unlocked position by orientation of the radial bulge 19 to the bulge 31. By relative rotation of the ventilation body 2 in the rotational direction D, this can then be brought into the locking position in which the locking members 15, 15' engage behind the bottom edge 6 of the high opening wall 3. In the locking position, the radial bulge 19 is vertically oriented in the downward direction, so that the end of the ventilating duct in the vertical direction is facing downwards.

The movement of the ventilation body 2 from the locking position into the unlocked position is done in the reverse direction of rotation.

The ventilation body 2 may be formed of the same or a different material to the housing.

The invention claimed is:

1. A ventilation system for vehicle lighting systems, comprising a housing opening with a protruding opening wall, a ventilation body, which is fixed to the housing opening by engagement of an inner part of the ventilation body, wherein the ventilation body and the housing opening have walls for forming a ventilation duct with a plurality of direction changes between an edge of the ventilation body and an aperture of the housing opening, wherein the ventilation body comprises the inner part (11) and an outer part (12), wherein the inner part (11) and the outer part (12) surround the opening wall (3, 8) of the housing opening (1) and have walls (17, 25, 28), which respectively sectionally lie circumferentially sealingly against the opening wall (3, 8) of the housing opening (1), and wherein the ventilation body (2) and the housing opening (1) are formed such that the ventilation body (2) can be brought from an unlocked position into a locked position or vice versa by rotation according to a predetermined angle of rotation relative to the housing opening (1).

2. The ventilation system according to claim 1, wherein the opening wall of the housing opening (1) is formed by an opening-bordering high opening wall (3) and a lower opening wall (8) arranged radially distanced from the high opening wall (3), wherein the high opening wall (3) has locking elements (7, 7', 7") at a rear side for fixing the inner part (11) of the ventilation body (2) in the locking position, and wherein the lower opening wall (8) has a recess (10) for forming an aperture (20) at one end of the ventilation duct.

3. The ventilation system according to claim 1, wherein the locking elements (7, 7', 7") of the high opening wall (3) and/or the inner part (11) are formed such that the ventilation body (2) in the locking position is form-fitting and/or friction-fitting held on the housing opening (1).

4. The ventilation system according to claim 1, wherein the inner part (11) of the ventilation body (2) has a radially projecting locking element (15, 15') at the free end, which in the locking position engages behind a bottom are portion (7') of the locking element (7) of the high housing opening (1) in a latching manner.

5. The ventilation system according to claim 1, wherein a bottom-side edge (6) of the high opening wall (3) is contoured in such a way that only one type of ventilation body (2) from a plurality of different types of ventilation bodies can be brought into the locking position.

6. The ventilation system according to claim 1, wherein the ventilation body (2) on the outer part (12) has a radial projection or bulge (19) which in the locked position is arranged on a side facing recess (10) of the lower opening wall (8).

7. The ventilation system according to claim 1, wherein the ventilation body (2) is designed such that on a half side facing of the outer end of the ventilation channel between the outer part (12) and the higher opening wall (3) two arc-shaped ventilation duct sections (22) form, which converge again on the side facing away from the radial collar (19) of the inner part (11).

8. The ventilation system according to claim 1, wherein the inner part (11) has a foot portion (13) on a side facing radial bulge (19), which has a radial surface (28), which bears sealingly on an inner side (29) of the high opening wall (3).

9. The ventilation system according to claim 1, wherein the inner part (11) on a side opposite the radial bulge (19) has a release (24) and/or a direction change wall (25) to form an axial ventilation channel section (26), which extends up to the bottom plane (B) of the housing opening (1).

10. The ventilation system according to claim 1, wherein the housing opening (1) comprises a projecting mounting frame (30) having an arcuate portion (32) and a bulge (31), wherein the bulge is designed such that the ventilation body (2) is rotatable only within a limited angle of rotation range between the unlocked and the locked position in the through-hole inserted position of the locking element (15, 15') of the inner part (11) in the opening of the high opening wall (13).

* * * * *